US009115454B2

(12) United States Patent
Pollett et al.

(10) Patent No.: US 9,115,454 B2
(45) Date of Patent: Aug. 25, 2015

(54) APPARATUS AND METHOD FOR SENSING AND ADDING DETERGENT TO WATER FOR A MACHINE APPLIANCE

(75) Inventors: James Quentin Pollett, Louisville, KY (US); Bryan James Beckley, Louisville, KY (US)

(73) Assignee: General Electric Company, Schenectady, NY (US)

( * ) Notice: Subject to any disclaimer, the term of this patent is extended or adjusted under 35 U.S.C. 154(b) by 1140 days.

(21) Appl. No.: 13/090,543

(22) Filed: Apr. 20, 2011

(65) Prior Publication Data

US 2012/0266387 A1 Oct. 25, 2012

(51) Int. Cl.

| | |
|---|---|
| ***D06F 39/00*** | (2006.01) |
| ***D06F 33/02*** | (2006.01) |
| ***D06F 35/00*** | (2006.01) |
| ***D06F 39/02*** | (2006.01) |

(52) U.S. Cl.

CPC ..... *D06F 39/006* (2013.01); *D06F 33/02* (2013.01); *D06F 35/006* (2013.01); *D06F 39/004* (2013.01); *D06F 39/022* (2013.01)

(58) Field of Classification Search

CPC ..... D06F 39/004; D06F 39/022; D06F 39/02; D06F 39/006; D06F 33/02; D06F 35/006

USPC ..... 8/158, 159

See application file for complete search history.

(56) References Cited

U.S. PATENT DOCUMENTS

| | | | | | |
|---|---|---|---|---|---|
| 5,253,379 | A * | 10/1993 | Dusamos et al. | ..... | 8/158 |
| 5,438,507 | A * | 8/1995 | Kim et al. | ..... | 700/1 |
| 6,269,667 | B1 * | 8/2001 | Back et al. | ..... | 68/17 R |
| 7,549,184 | B2 * | 6/2009 | Zhang | ..... | 8/159 |
| 7,690,061 | B2 | 4/2010 | Potyrailo et al. | | |
| 2001/0027580 | A1 * | 10/2001 | Back et al. | ..... | 8/158 |
| 2002/0162177 | A1 * | 11/2002 | Raney et al. | ..... | 8/158 |
| 2003/0213069 | A1 | 11/2003 | Tortorici, Jr. et al. | | |
| 2004/0226959 | A1 * | 11/2004 | Mehus et al. | ..... | 222/1 |
| 2006/0123563 | A1 * | 6/2006 | Raney et al. | ..... | 8/158 |
| 2006/0272101 | A1 * | 12/2006 | Zhang | ..... | 8/147 |
| 2008/0184746 | A1 * | 8/2008 | Agarwal | ..... | 68/12.02 |
| 2010/0050345 | A1 * | 3/2010 | Kim et al. | ..... | 8/159 |

FOREIGN PATENT DOCUMENTS

| | | | | | |
|---|---|---|---|---|---|
| DE | 102007041069 | A1 * | 3/2009 | ..... | D06F 39/00 |
| GB | 2052251 | A * | 1/1981 | ..... | A47L 15/46 |
| GB | 2 151 263 | A | 7/1985 | | |

* cited by examiner

*Primary Examiner* — Joseph L Perrin
(74) *Attorney, Agent, or Firm* — Dority & Manning, P.A.

(57) ABSTRACT

A method and apparatus for determining the amount of detergent in water used in a washing machine and to supplementing such water as needed for a wash load is provided. The amount of detergent present in grey water that is reused for washing, as well as the amount released from clothes or other articles to be washed, can also be determined.

8 Claims, 6 Drawing Sheets

FIG. –1–

APPARATUS AND METHOD FOR SENSING AND ADDING DETERGENT TO WATER FOR A MACHINE APPLIANCE

FIELD OF THE INVENTION

The present invention relates to a method and apparatus for determining the amount of detergent in water used in a washing machine and to supplementing such water as needed for a wash load.

BACKGROUND OF THE INVENTION

Water is a critical natural resource for which demand is high. In addition to clean water for consumption, there is a need for the conservation of water as demand on available resources continues to grow. As such, products which contribute to the recycling and conservation of water resources are desirable to certain consumers and may be required by legislation.

The washing machine is an appliance that is commonly found in residential and commercial settings and which typically uses water to properly clean e.g., clothes, linens, towels, and other machine washable items. A detergent, generally one that contains surfactants and possibly brighteners as well, is added to the water for cleaning. For certain applications, it can be desirable to recycle the water effluent from a washing machine. More particularly, water from the wash cycle, rinse cycle, or combinations thereof can be recycled by using such water again during the washing cycle.

Grey water refers to the effluent from a washing machine appliance that was used during a cycle in the washing machine. For example, grey water is created during a wash cycle. The water that is used for washing clothes or other articles will eventually come to contain e.g., detergent and other matter released from the clothes during the washing process. Grey water is also created during rinse cycle. Water that is added to the clothes during the rinse cycle will also eventually contain e.g., detergent that is released during the rinse and/or spin process.

While grey water can be reused in the washing cycle of a washing machine appliance, allowance must be made for both the capture of the grey water and adjustment for the detergent already present in the grey water. Some of the detergent that is added for a wash cycle is depleted by e.g., removal when the clothes are taken from the washing machine or otherwise by conversion to other substances as part of the washing process. However, a significant amount of detergent will remain in the grey water. This amount of residual detergent must be considered when determining how much detergent must be added when the grey water is recycled for use in another wash cycle.

Typically, the rinse cycle of a washing machine does not remove all of the detergent used during the wash cycle. Some of the detergent remains on the clothes even after rinsing. Accordingly, when the clothes are worn and then washed again, the detergent present in the clothes can contribute to the amount of detergent present in the water used for washing. When too much detergent is added during a wash cycle, this can further increase the amount of detergent that remains on the clothes. In turn, this can lead to a graying effect on the clothes as the detergent builds up over time, can contribute to a roughness feeling, and potentially may even affect skin allergies. Excess detergent can also cause excess suds which may be undesirably left on the clothes after a wash cycle, cause damage to the washing machine, and/or cause the spin speed to decrease therefore causing the clothes to retain too much water.

Accordingly, a system for the reuse of grey water in a washing machine appliance would be useful. More particularly, a system that can allow for measuring of the amount of detergent in grey water and a determination of the proper amount of detergent for supplementing such grey water would be beneficial. Such a system that can also be used to adjust the amount of detergent added to the water by the clothes or other items being washed would also be particularly useful.

BRIEF DESCRIPTION OF THE INVENTION

Aspects and advantages of the invention will be set forth in part in the following description, or may be obvious from the description, or may be learned through practice of the invention.

In one exemplary aspect, the present invention provides a method for operating a washing machine that includes the steps of loading articles to be washed into the washing machine so as to create a wash load; adding water to the wash load of articles in the washing machine; ascertaining the size of the wash load of articles in the washing machine; measuring the amount of detergent present in the water; determining the amount of detergent to add to the water in the washing machine; adding the amount of detergent from the step of determining to the water in the washing machine; and, executing a laundering cycle for the wash load of articles in the washing machine.

In another exemplary embodiment, the present invention provides a washing machine that includes a wash chamber for containing articles to be washed; an agitation device present in the wash chamber for moving the articles to be washed within the wash chamber; a device for measuring the size of the load of articles; and a detergent sensor for measuring detergent present in water to be used for washing articles in the wash chamber. This exemplary embodiment includes at least one processing device configured for determining the amount of detergent to add to the water based on measurements received from the device for measuring the size of the load of articles and the detergent sensor; and configured for executing a laundering cycle, after water and detergent have been added to the wash chamber, so as to wash articles placed in the wash chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

The use of identical or similar reference numerals is intended to represent identical or similar features in the figures.

DETAILED DESCRIPTION OF THE INVENTION

Figure 1:
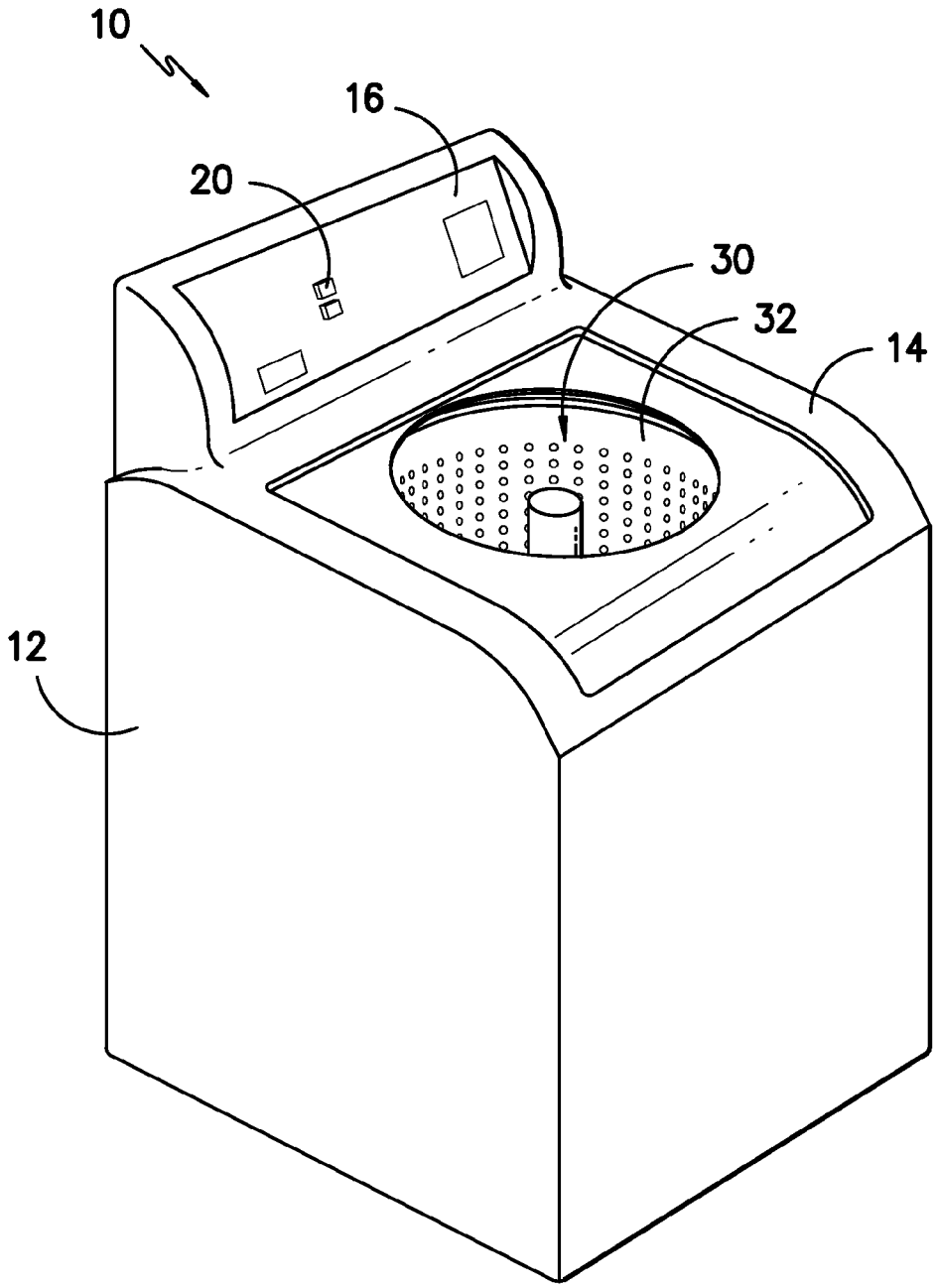
FIG. 1 provides a perspective view of an exemplary vertical axis washing machine as may be used with the present invention.

The present invention relates to a method and apparatus for determining the amount of detergent in water used in a washing machine and to supplementing such water as needed for a wash load. The amount of detergent present in grey water that is reused for washing as well as the amount released from clothes or other articles to be washed can also be determined. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to but need not be limited to fabrics, textiles, garments (or clothing), and linens. Furthermore, the term "load" or "wash load" refers to the combination of articles that may be washed together in a washing machine and may include a mixture of different or similar articles of different or similar types and kinds of fabrics, textiles, garments and linens within a particular laundering process. The term "water" is intended to broadly refer to a liquid phase used during a "wash cycle" or "rinse cycle" of a laundering process. "Grey water" refers to water that was previously used in a wash or rinse cycle and, therefore, may contain detergents. "Fresh water" refers to water that does not contain detergents from a previous wash cycle.

The term "wash cycle" is intended to refer to one or more periods of time, in which a washing machine that contains the articles to be laundered operates using a detergent and water, preferably with agitation to e.g., remove dirt and odors from the articles. The term "rinse cycle" is intended to refer to one or more periods of time in which the washing machine operates to remove residual detergents that were retained by the articles after completion of the wash cycle. The term "spin cycle" is intended to refer to one or more periods of time during which the washing machine rotates the article so as to create centrifugal forces to remove water, typically grey water, from the article after a wash or rinse cycle. As used herein, the terms "laundering" or "laundering cycle" refers to an article cleaning process by which articles to be cleaned are exposed to one or more cleaning agents and to rinsing. The laundering process typically includes at least one wash cycle, rinse cycle, and spin cycle, and may include multiple such cycles in various combinations.

Figure 2:
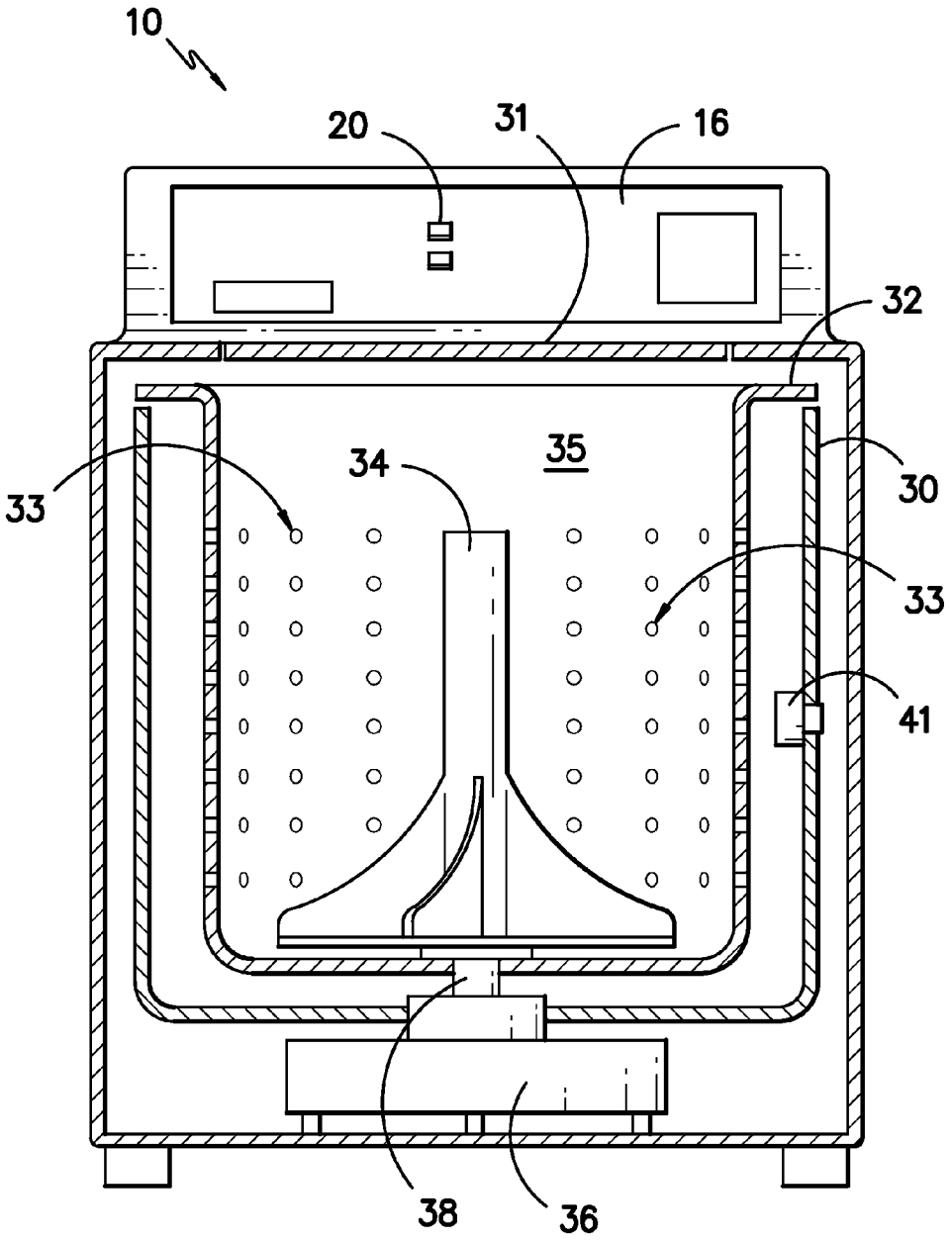
FIG. 2 is a cross-sectional view of the exemplary washing machine of FIG. 1.

FIG. 1 is a perspective view of an exemplary vertical axis washing machine 10 that includes a cabinet 12 having a cover 14. FIG. 2 provides a cross-sectional view of the machine 10 of FIG. 1. A backsplash 16 extends from cover 14, and a variety of appliance control input selectors 20 are coupled to backsplash 16. Input selectors 20 form a user interface for operator selection of washing cycles and features. For clarity of illustration, a door 31 is not shown in FIG. 1 so that the interior of machine 10 is visible—door 31 is shown in cross-section in FIG. 2.

A wash chamber 30 is located within cabinet 12, and a wash basket 32 is rotatably mounted within wash chamber 30 in a spaced apart relationship from wash chamber 30. Basket 32 includes a plurality of perforations 33 therein to facilitate fluid communication between the interior 35 of basket 32 and wash tub 30. An agitator, impeller, or oscillatory basket mechanism 34 is disposed in basket 32 to impart an oscillatory motion to articles and liquid in basket 32. Motor 36 provides for the movement of agitator 34 through connection by shaft 38. Wash chamber 30 is also in fluid communication with one or more pumps and/or drains for the removal of water, such as grey water, from chamber 30 such as e.g., after a wash or rinse cycle.

Washing machine 10 is controlled by a processing device or other controller, such as a microprocessor (not shown), according to user preference via manipulation of control input selectors 20 mounted on backsplash 16. As used herein, processing device may refer to one or more microprocessors or semiconductors devices and is not restricted necessarily to a single element. The processing device can be programmed to operate washing machine 10 according to the exemplary aspects of the present invention as set forth below.

As illustrated in FIG. 1, agitator 34 is oriented to rotate about a vertical axis. It is contemplated, however, that at least some of the benefits of the present invention can apply to horizontal axis washing machines as well. More specifically, the washing machine of FIGS. 1 and 2 is provided by way of example only. Using the teachings disclosed herein, one of ordinary skill in the art will understand the present invention may be used with washing machines of various other configurations in both residential and commercial applications.

Figure 3:
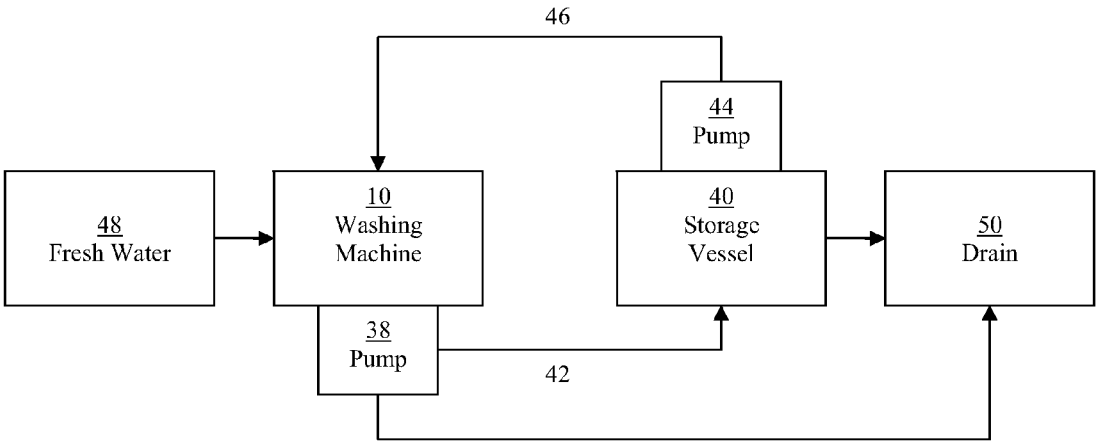
FIG. 3 provides a schematic representation of washing machine system as may be used with the present invention.

As shown schematically in FIG. 3, washing machine 10 could be connected with a storage vessel 40 for holding grey water that has been removed from wash chamber 30. Storage vessel 40 could be a part of washing machine 10 or a separate appliance that is connected to machine 10. For example, washing machine 10 could include a pump 38 and be connected by piping or tubing 42 to holding tank 40. Upon completion of a wash or rinse cycle, the pump 38 could be activated by e.g., the processing device to transport grey water from wash chamber 30 of machine 10 to holding tank 40. Similarly, tank 40 may include a pump 44 for the movement of grey water by tubing 46 back to washing machine 10. FIG. 3 is provided by way of example only. With appropriate valving, the same pump and tubing could be used to transport grey water back and forth between washing machine 10 and tank 40. Other configurations may be used as well. If desired, filtration devices could be added to remove certain materials from the grey water. Washing machine 10 is also connected with a supply of make-up, fresh water 48—i.e., non-grey water that can also be used to fill machine 10 or supplement grey water from tank 40. Washing machine 10, tank 40, or both may also be connected to a drain 50.

Figure 4:
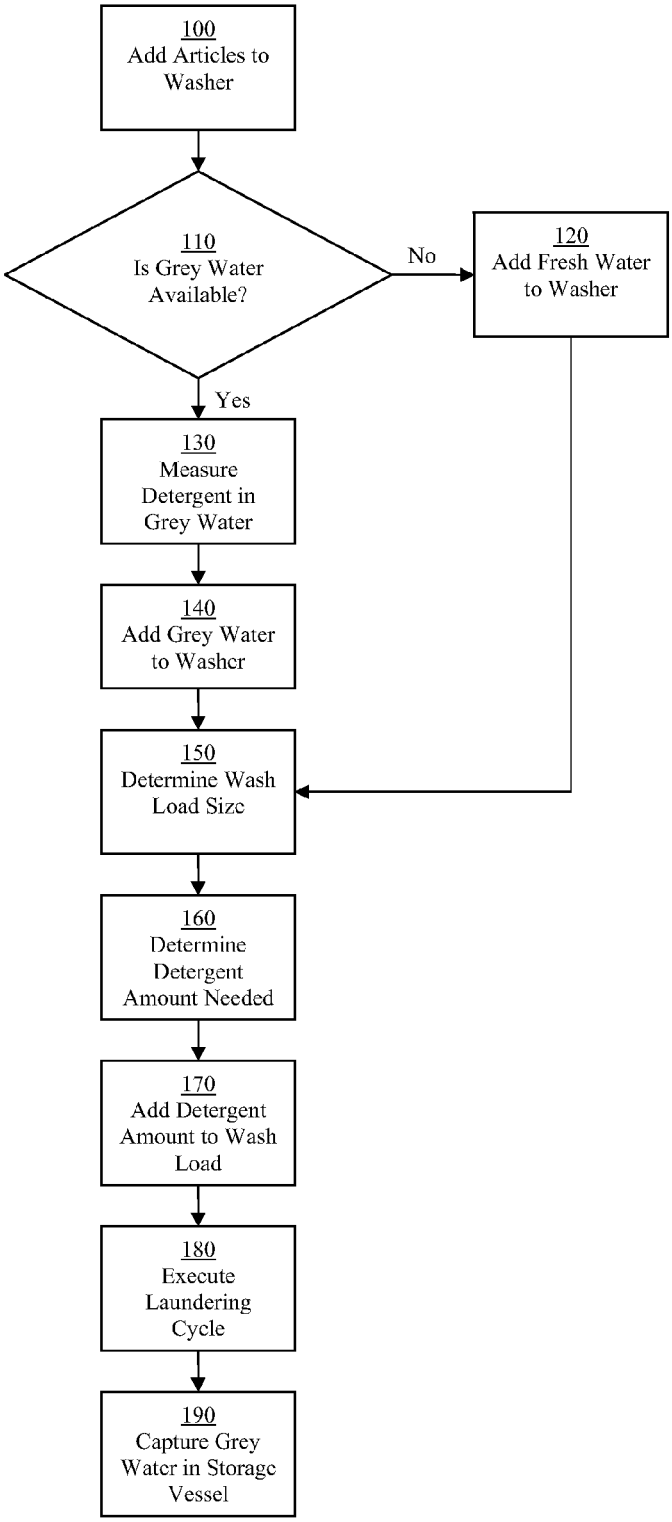
FIGS. 4 through 6 are flow charts illustrating exemplary methods of operating a washing machine in accordance with the present invention.

FIG. 4 provides a flow chart setting forth an exemplary method of operating washing machine 10 according to the present invention. In step 100, articles are added to the washing machine 10 (or washer). Typically, this is completed manually as a user adds articles to be washed after raising door 31. Depending upon the amount and size of the articles, wash loads of varying amounts may be added by the user.

In step 110, the processing device determines whether grey water is available. This may be determined, e.g., by a sensor placed on tank 40 for determining the presence and/or level of grey water in storage. If no grey water is available, fresh water 48 is added to the wash chamber 30 of washing machine 10. The processing device may complete this step by e.g., opening a valve to supply fresh water into chamber 30. Alternatively, if grey water is available, then in step 130 the amount of detergent present in the grey water is measured by e.g., sensing the concentration of detergent in the grey water and/or the amount of such grey water in tank 40. If the amount of grey water is insufficient, such can be supplemented by fresh water 48. If the amount of grey water is greater than the amount required, the excess grey water can either be held for a subsequent laundering cycle or pumped out using pump 44 to the drain 50.

A variety of techniques may be used for measuring how much detergent is present in the grey water. For example a photometric analysis may be performed on the grey water from a cycle of an article laundering process to determine a relative or absolute detergent concentration. Since many commonly available detergents contain fluorescing components or optical brighteners in the form of chromophores that contribute to ultraviolet absorbance and ultraviolet light induced fluorescence, a detergent concentration within grey water may be ascertained based at least in part upon fluorescent properties of the grey water. The term "fluorescent properties" may refer to whether a substance such as grey water fluoresces as well as the respective emission and absorption spectra related to the substance. The use of the term "fluorescence" herein is intended to be inclusive and includes the emission properties with fluorescence lifetimes ranging from 0.02 nanoseconds to 100 seconds, preferably from 0.2 nanoseconds to 50 seconds, and more preferably from 0.25 nanoseconds to 10 seconds. As used herein, the term fluorescence is intended to include emission and luminescence.

For example, as described in U.S. Pat. No. 7,690,061, an optical sensor may be configured within tank 40 to expose the grey water to a first radiation and to detect a second radiation emitted by the grey water responsive to the first radiation. The sensor may include a radiation-emitting element such as a light emitting diode (LED) to emit radiation at a first wavelength or range of wavelengths, and a radiation-detecting element such as a photodiode to detect radiation emitted by the grey water in a second wavelength or range of wavelengths, which may but need not coincide with the emission wavelengths. In one embodiment, the sensor may emit radiation at wavelengths in the range of about 200 nm to about 500 nm. In another embodiment, the sensor may emit radiation at wavelengths in the range of about 220 nm to about 450 nm. In yet another embodiment, the sensor may emit radiation at wavelengths in the range of about 300 nm to about 410 nm. Additionally, the sensor may detect radiation at wavelengths in the range of about 300 nm to about 600 nm. In another embodiment, the sensor may detect radiation at wavelengths in the range of about 330 nm to about 630 nm. In still another embodiment, the sensor may detect radiation at wavelengths in the range of about 350 nm to about 600 nm. In still another example, pH measuring sensor, a surface tension sensor such as surface tensiometer, and other known devices may be used for measuring the concentration of detergent present in wash chamber 30.

After the amount of detergent in the grey water has been measured, the grey water is added to wash chamber 30. Alternatively, the amount of detergent may be measuring dynamically in tubing 46 as the grey water is added to wash chamber 30. Tubing 46 to washing machine 10 may be equipped e.g., with a valve controlled by the processing device. Such valve can be opened and/or a pump activated to begin the flow of grey water into machine 10. As grey water is added, chamber 30 is filled and the articles present therein will become wetted and/or absorb some of the grey water. In the event the amount of grey water is less than needed for a particular wash load, the process device can be equipped to supplement chamber 30 with fresh water 48. If grey water is not available, then in step 120, fresh water is added to wash chamber 30.

As the grey water and/or fresh water is added, in step 150 the wash load size is determined. Several different devices and/or techniques may be used to determine the size of the wash load. By way of example, a level sensor may be provided with washing machine 10 for determining the amount of water present in chamber 30. Alternatively, the wash load size may be user selected by controls 20 placed on backsplash 16 of machine 10 based on the volume of articles to be washed. The wash load size can also be determined by the amount of torque required to spin the wash basket 32. Other devices and/or techniques may be used as well.

Once the wash load size is determined, the processing device can then determine the amount of detergent that should be added to wash chamber 30. The determination can be made by subtracting the amount of detergent present in the grey water now in chamber 30 from the total amount of detergent required for a particular wash load size. If only fresh water was added to chamber 30, then the only detergent contributed to wash chamber 30 would come from the articles to be washed as will be further discussed. For determining the amount of detergent to add, the processing device can be e.g., equipped with or connected with a memory device wherein the required amount of detergent for a given load is stored. Based on the load size in chamber 30, the processing device would access the memory device to retrieve information regarding the amount of detergent required for such load size. Then, the current amount of detergent present in chamber 30 would be subtracted to determine the amount of detergent needed as required in step 160. While the term "amount" has been referred to above, using the teachings disclosed herein, one of skill in the art will understand such term to include the use of detergent concentrations for a given volume of water present as one means that may also be used in determining the amount of detergent that must be added to chamber 30.

In step 170, the amount of detergent determined in step 160 is added to wash chamber 30. Detergent addition can be accomplished automatically by use of a bulk dispenser. The processing device can e.g., be configured to activate such dispenser to automatically add the amount of detergent needed into chamber 30. Alternatively, such detergent could be added manually by providing a prompt to the user. A display can be provided e.g., on backsplash 16 that prompts the user with the required amount of detergent for addition to chamber 30.

Once the proper amount of detergent has been added such that the overall required amount of detergent is present in chamber 30, a laundering cycle is executed in step 180. As set forth above, a laundering cycle may include a wash cycle to remove soils form the articles. The laundering cycle can include cyclic motion using agitator 34. Following the wash cycle, grey water would then be drained from chamber 30. Basket 32 can be then be rotated in a spin cycle to wring additional grey water from the articles. The grey water from the spin cycle can also be drained from chamber 30. Next, laundering step 180 can include a rinse cycle where fresh water is added to the articles with cyclic motion from agitator 34. Following the rinse cycle, grey water can again be drained from chamber 30. An additional spin cycle followed by grey water drainage can then be used to remove additional grey water from the articles and complete the laundering cycle of step 180. The laundering cycle just described is provided by way of example only. Various other combinations of the wash, spin, and rinse cycles with drainage of the grey water may also be employed for the laundering cycle executed in step 180.

In step 190 the grey water drained from chamber 30 during the execution of the laundering cycle in step 180 can be captured and stored e.g., in vessel 40. Although shown as following step 180 in FIG. 4, it will be understood that step 190 can be executed simultaneously with step 180 or at various stages of step 180 as grey water is created during the laundering cycle.

Figure 5:
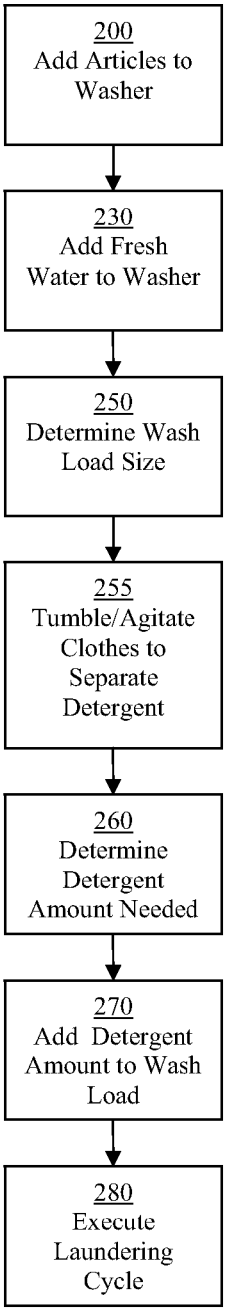

As previously stated, due to variations in laundry load size and detergent usage amounts from one laundering cycle to another, it is very common for clothes to contain residual amounts of detergent even after all rinse cycles have been completed. Accordingly, FIG. 5 provides another flow chart setting forth an exemplary method of operating washing machine 10 in accordance with the present invention. In step 200, articles to be washed are added to the washer. Instead of the use of grey water, fresh water is added to chamber 30 in step 230. The size of the wash load is determined in step 250 in a manner as previously described. Now, in order to help release the residual detergent that may be contained in the articles, the articles are tumbled or agitated with the fresh water in step 255. For example, this can be accomplished by causing agitator 34 to operate in a cyclic manner. Step 255 is continued for an interval of time sufficient to allow the residual detergent to be released into the water. This time may vary depending e.g., upon the size of the wash load, the water temperature, and the amount of residual detergent in the articles.

In step 260, a determination is made as to how much detergent must be added to the water. A sensor, such as e.g., sensor 41 in FIG. 2 that is located within wash chamber 30 of machine 10, is used to determine how much detergent was released into the water during step 255. Using this information, in a manner as previously described, the processing device can subtract the residual amount of detergent present in the water of wash chamber 30 from the required amount of detergent for the given wash load size that is present in order to determine the amount of detergent that must be added to chamber 30. The required amount of detergent is added to the wash chamber 30 in step 270, which can be accomplished automatically or manually as previously described with regard to step 170. Finally, a laundering cycle is executed in step 280 and can include various cycles as set forth above.

Figure 6:
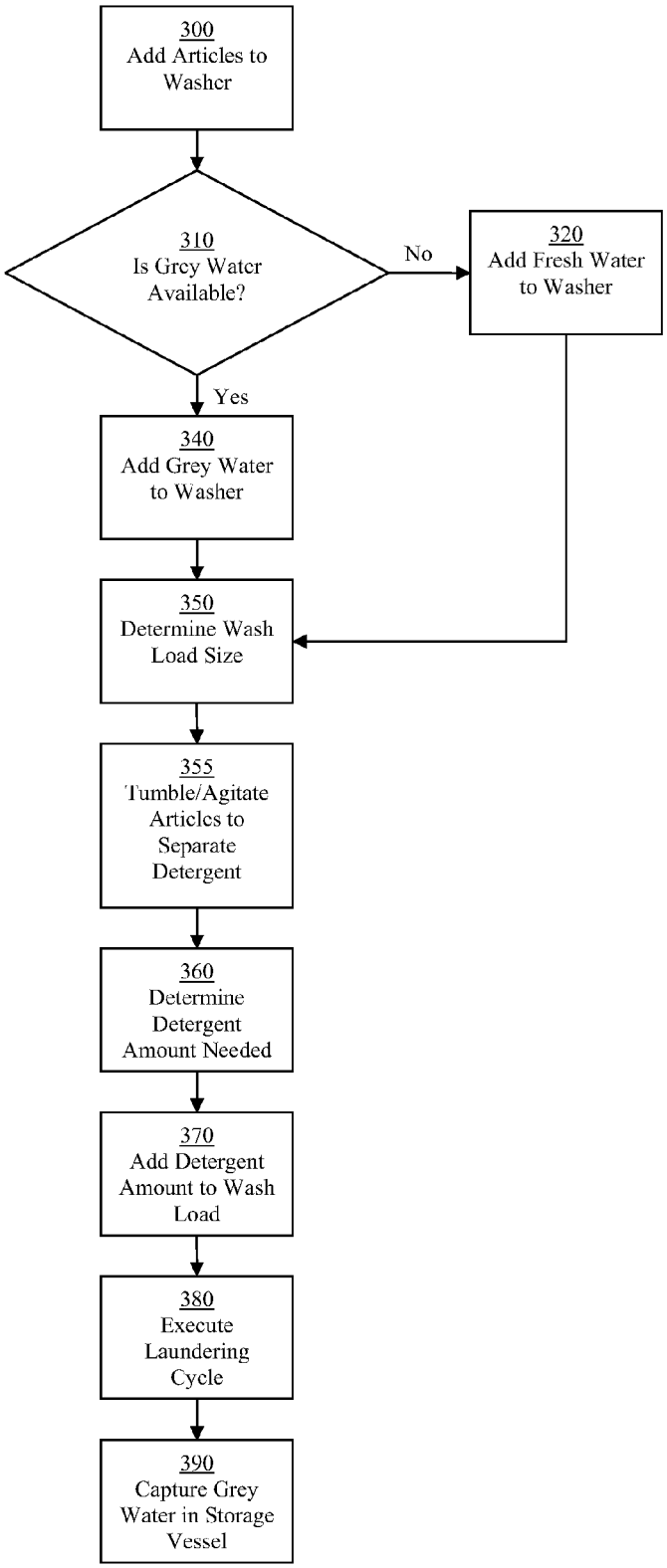

FIG. 6 provides another flow chart illustrating still another exemplary method of operating a washing machine in accordance with the present invention. The method set forth in FIG. 6 is in some aspects a combination of the methods of FIGS. 4 and 5 in that adjustment for both the amount of detergent present in recycled grey water is provided as well as adjustment for residual detergent in the articles of the wash load.

More specifically, after the articles have been loaded into the washer and grey water has been added to the wash load (along with any fresh water required to supplement the grey water or substitute for it if none is available), the wash load is agitated in step 355 for an interval of time sufficient to allow residual detergent in the articles to be released into the water. Once step 355 is completed, the amount of detergent to be added can be determined in step 360 as previously described by subtracting the amount present in the water from the amount required for the wash load size present in chamber 30. The remaining steps 370, 380, and 390 can be completed in a manner as previously described. As such, the exemplary method of FIG. 6 accounts for both the amount of detergent contributed by the recycled grey water as well as residual detergent that was present in the articles being washed before such were added to wash chamber 30.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine comprising the steps of:

loading articles to be washed into the washing machine so as to create a wash load;

adding water to the wash load of articles in the washing machine, wherein the water is grey water, fresh water, or both;

ascertaining the size of the wash load of articles in the washing machine;

measuring the concentration of detergent present in the water in the washing machine using at least one sensor selected from the group consisting of pH sensor, optical sensor, electrical conductivity sensor, and surface tensiometer, said at least one sensor disposed inside a washing chamber;

determining the amount of detergent to add to the water in the washing machine using the steps of:

retrieving information regarding the preferred detergent concentration for the size of the wash load of articles as provided by said step of ascertaining; and, subtracting from a preferred detergent concentration the detergent concentration already present in the water in the washing machine as provided by said step of measuring;

adding the amount of detergent from said step of determining to the water in the washing machine; and, executing a laundering cycle for the wash load of articles in the washing machine.

2. A method for operating a washing machine as in claim 1, wherein said step of adding comprises allowing grey water from a storage vessel to be placed into the washing machine, and wherein said step of measuring the amount of detergent present in the water is applied to the grey water before being placed into the washing machine from the storage vessel.

3. A method for operating a washing machine as in claim 1, wherein said step of measuring comprises sensing the presence of fluorescing components in the water.

4. A method for operating a washing machine as in claim 1, wherein said step of measuring comprises detecting the fluorescent properties of the water.

5. A method for operating a washing machine as in claim 1, further comprising the step of agitating the articles in the washing machine before said step of measuring so as to release residual detergent present in the articles.

6. A method for operating a washing machine as in claim 1, further comprising the step of capturing grey water removed from the washing machine during said step of executing a laundering cycle.

7. A method for operating a washing machine as in claim 6, wherein said step of executing a laundering cycle comprises the steps of draining grey water from the washing machine; spinning the articles; rinsing the articles; or, combinations thereof.

8. A method for operating a washing machine as in claim 7, further comprising the step of reusing in the washing machine the grey water drained from the washing machine during said step of draining.

* * * * *